United States Patent [19]

Carson

[11] Patent Number: 4,949,889

[45] Date of Patent: Aug. 21, 1990

[54] BRACKET FOR MOUNTING AUXILIARY COMPRESSED AIR TANK TO A MAIN TANK

[76] Inventor: Ronald H. Carson, 3919 S. Holden Rd., Greensboro, N.C. 27406

[21] Appl. No.: 365,750

[22] Filed: Jun. 13, 1989

[51] Int. Cl.[5] ..... A45F 5/00

[52] U.S. Cl. ..... 224/270; 224/271; 224/269; 128/205.22

[58] Field of Search ..... 224/272, 271, 270, 269, 224/42.45 R, 42.46 R; 405/186, 187; 128/201.27, 201.29, 205.22; 248/223.4, 318, 311.2; 294/150, 149, 154

[56] References Cited

U.S. PATENT DOCUMENTS

| | | | |
|---|---|---|---|
| 2,238,759 | 4/1941 | Vestrem | 128/201.27 |
| 2,406,888 | 9/1946 | Meidienbauer | 128/202.27 |
| 3,065,888 | 11/1962 | Lande . | |
| 3,247,564 | 4/1966 | Barnum | 24/459 |
| 3,269,129 | 8/1966 | Zambrano . | |
| 3,310,270 | 3/1967 | Ciancio | 248/318 |
| 3,495,413 | 2/1970 | Pinto . | |
| 3,842,611 | 10/1974 | Anderson . | |
| 4,116,374 | 9/1978 | Garello | 294/150 |

*Primary Examiner*—Linda J. Sholl

*Attorney, Agent, or Firm*—Shefte, Pinckney & Sawyer

[57] ABSTRACT

An apparatus for releasably mounting an auxiliary compressed air tank to a breathing apparatus of the type having a main compressed air tank is provided. The apparatus includes a bracket having a pair of mounting legs connected in relatively closely spaced facing relation to one another defining a strap receiving area and means for clamping one of the mounting legs rigidly with the other mounting leg spaced outwardly therefrom. One of the mounting legs is selectively insertable and removable from a disposition between the main compressed air tank and a securing strap of a harness which supports the main compressed air tank on a user. The harness strap is received in the strap receiving area and the strap is tightened to hold the auxiliary tank relative to the main tank. To release the auxiliary tank, the strap is loosened and the mounting leg is moved to clear the strap.

5 Claims, 3 Drawing Sheets

BRACKET FOR MOUNTING AUXILIARY COMPRESSED AIR TANK TO A MAIN TANK

BACKGROUND OF THE INVENTION

The present invention relates to a bracket for mounting an auxiliary compressed air breathing tank to a main compressed air breathing tank.

Portable air tanks are widely used in a number of environments to provide a source of breathing air. For example, air tanks are used by underwater divers, fire fighters and workers involved with toxic chemicals. Such tanks are commonly constructed of a metal-walled, closed-end cylinder filled with compressed air and having an openable and closable valve at one end for releasing the compressed air therein. Typically, the air tank is securely mounted to the back of a vest or like harness worn about the torso of the user which supports the air tank in a generally upright disposition on the user's back during use.

Due to the inherent unavailability of oxygen and the other dangers of the environments in which breathing air tanks are used, it is critical that safeguards be taken to assure the tank user of an uninterrupted source of breathing air. Thus, it is recommended practice that air tank users carry a back-up air supply for use in the event of malfunction or exhaustion of the compressed air of the air tank. One preferred back-up air supply is an auxiliary or so-called "Pony" breathing air tank carried on the harness which supports the main air tank to provide a second emergency source of breathing air which can be accessed by the user. The main air tank and the auxiliary air tank are typically each provided with separate means for delivering the air from the tank to the user, usually a flexible hose extending from the air control value of the tank and having a mouthpiece called a "regulator" at its distal end for disposition in the user's mouth.

Since the user only operates the auxiliary air tank in the event of a malfunction or exhaustion of the main breathing air tank, it is generally not necessary for the auxiliary tank to provide a breathing air source of a relatively long duration since the prudent user will seek to exit the underwater or toxic environment immediately after putting the auxiliary tank into use. For this reason, the auxiliary air tank is typically of reduced scale compared to the main breathing air tank. However, in spite of the reduced size of the auxiliary tank, the competing design considerations of reliably securing the auxiliary tank to the harness for transport therewith while at the same time minimizing the size and complexity of the equipment present a considerable design challenge. Preferably, the auxiliary tank should be mounted to the harness in tandem with the main tank so that the user's range of movement is not additionally limited. On the other hand, the tandem disposition of the main and auxiliary tanks creates the need to secure the two tanks so that they do not collide with one another during movement of the user.

One known device for securing an auxiliary breathing tank to a main breathing air tank is a fabric loop secured to the auxiliary tank by a pair of spaced apart, parallel screw-type metal clamps or another suitable strap inserted through the loop and extending securely about the circumferential extent of the auxiliary tank, whereby the fabric loop is adapted for similar insertion therethrough of the webbing or belt which secures the main breathing air tank to the harness so that both the auxiliary and main tanks are held to the vest or harness by the belt. However, this device suffers from several recognized disadvantages. First, in order to mount and demount the auxiliary tank, the retaining belt of the vest or harness must be completely unstrapped from the main tank to allow the belt to be inserted through and withdrawn from the fabric loop. Further, during normal use, the non-rigid fabric loop tends to move or twist at least slightly, thus introducing movement between the auxiliary tank and the main tank which gives the user an unstable feeling.

Accordingly, the need exists for an apparatus for securing an auxiliary breathing tank to a main air tank in which movement between the two tanks is minimized. Additionally, the need exists for an auxiliary tank mounting apparatus which reliably mounts the auxiliary tank to the main tank while providing the capability to readily and easily install and remove the auxiliary tank without completely unstrapping the tank retaining belt of the user's harness.

SUMMARY OF THE INVENTION

The present invention provides apparatus which rigidly secures an auxiliary breathing tank to a main breathing air tank assembly while minimizing abrasive contact or damaging collisions between the two tanks and which further readily facilitates installation and removal of the auxiliary tank.

Briefly described, the present invention provides an apparatus for releasably mounting an auxiliary compressed air tank to a breathing apparatus for releasably mounting an auxiliary compressed air tank to a breathing apparatus of the type having a harness with a strap for securing a main compressed air tank to the harness. The apparatus includes a bracket having a pair of mounting legs connected in relatively closely spaced facing relation to one another and defining therebetween a strap receiving area with respective adjacent ends of the legs unconnected to one another defining a strap insertion slot into the strap receiving area and means for clamping one mounting leg rigidly to the auxiliary tank with the other mounting leg spaced outwardly therefrom. The other mounting leg is selectively insertable into and removable from a disposition between the main tank and the securing strap of the harness in which the strap is inserted through the strap insertion slot into the strap receiving area of the bracket when the strap is in a loosened condition and in which the other mounting leg is rigidly held between the strap and the main tank when the strap is tightened to effect rigid mounting of the auxiliary tank to the main tank.

In the preferred embodiment, the bracket includes a generally L-shaped rigid member having the one mounting leg and a foot oriented transversely to one another and configured for engagement of the foot with a bottom surface of the auxiliary tank and for engagement of the one leg with a lengthwise surface of the auxiliary tank. The preferred bracket further includes a second generally L-shaped rigid member having the other mounting leg and a second foot oriented transversely to one another, the second foot being affixed to the one mounting leg at a spacing from the foot of the first L-shaped rigid member and the other mounting leg extending toward the foot of the first L-shaped rigid member in relatively closely spaced facing relation to the one mounting leg.

The rigid clamping means preferably includes strap means for generally circumferentially encircling the auxiliary tank and the one mounting leg to rigidly retain the auxiliary tank and the L-shaped rigid member in engagement with one another. For example, the strap means may include a pair of screw-type metal clamping bands for generally circumferentially encircling the auxiliary tank and the one mounting leg at spaced locations along the auxiliary tank. A generally non-abrasive covering is preferably secured to each mounting leg of the bracket for minimizing abrasive contact between the bracket and the auxiliary and main tanks.

DETAILED DESCRIPTION OF THE PREFERRED EMBODIMENT

Figure 1:
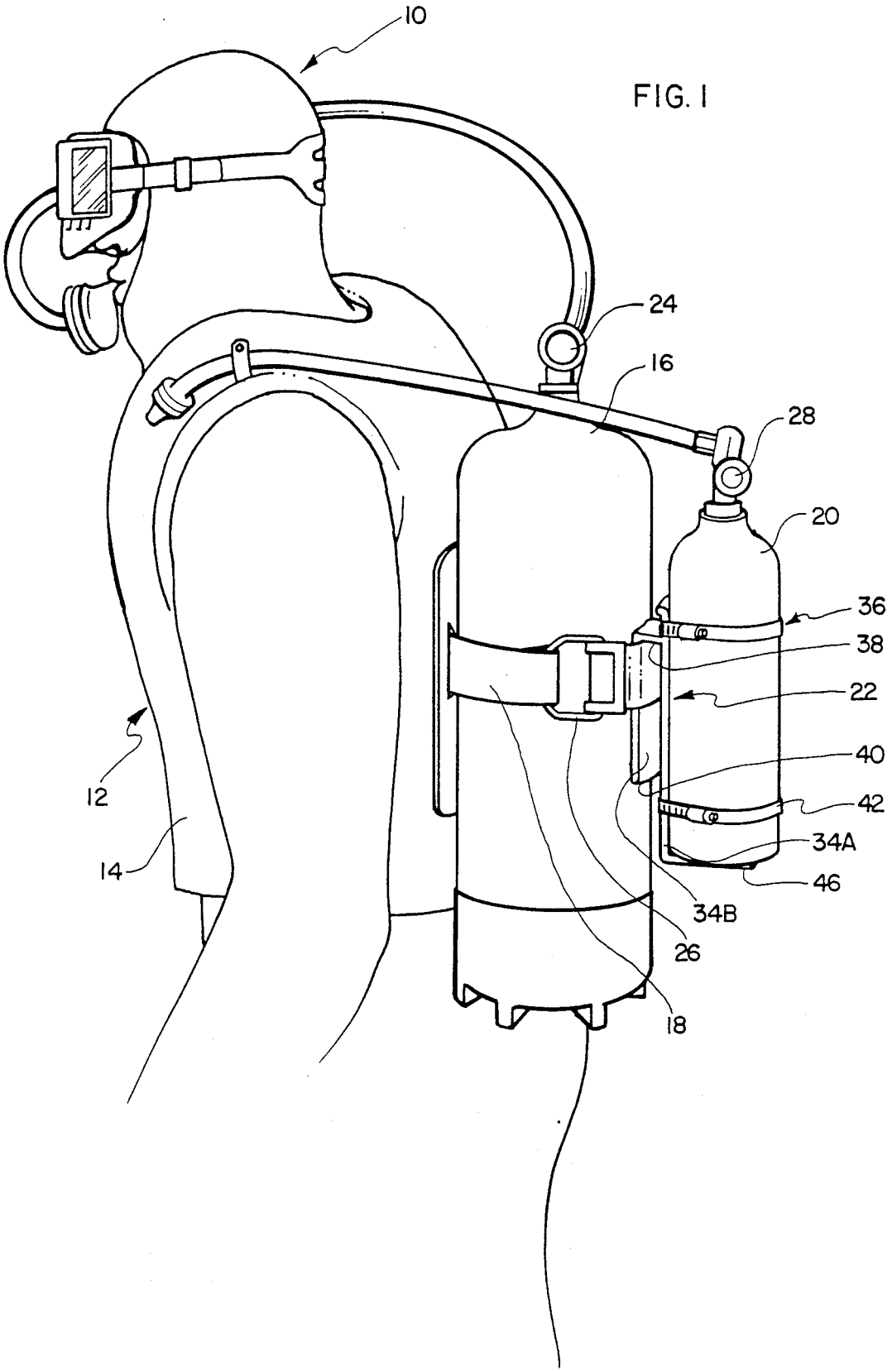
FIG. 1 is a perspective view of the preferred embodiment of the tank mounting apparatus of the present invention, showing the apparatus in use for mounting an auxiliary breathing air tank to a main breathing air tank and harness assembly.
Figure 2:
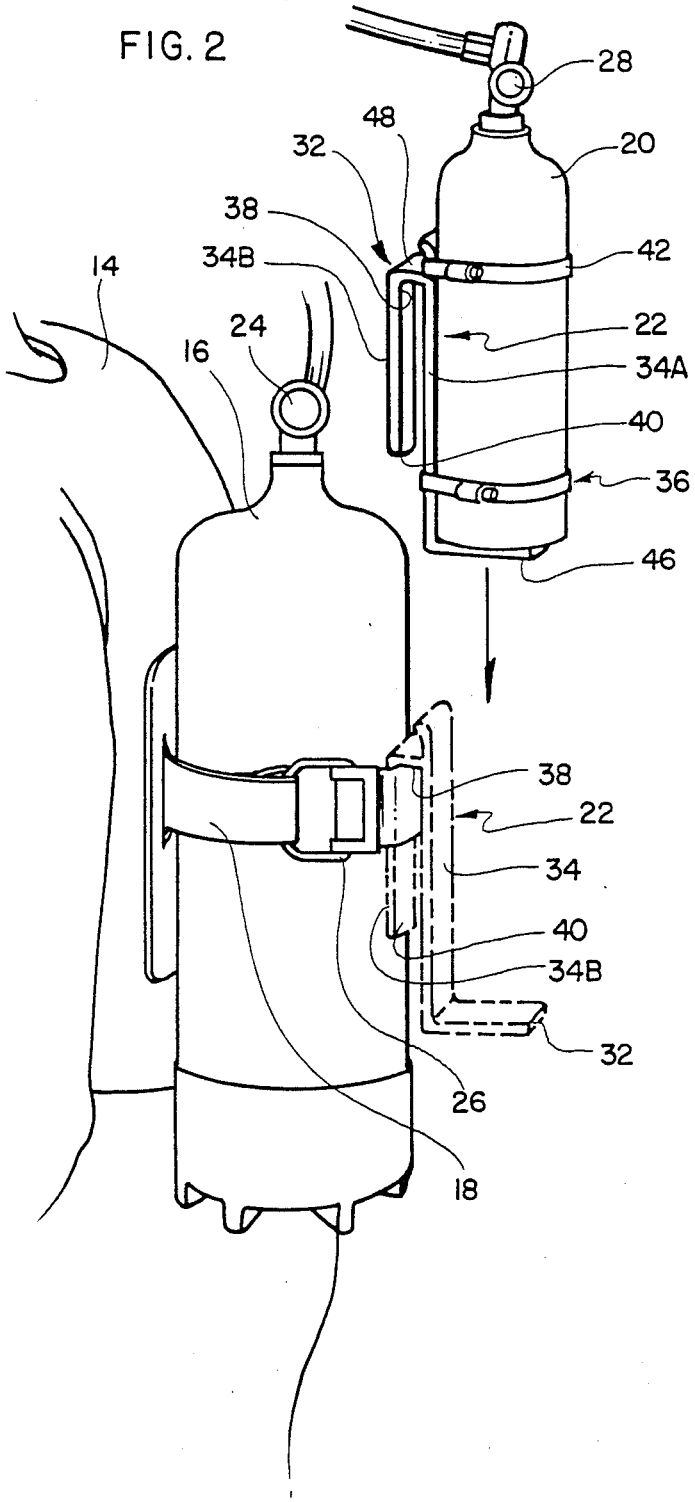
FIG. 2 is a perspective view of the apparatus shown in FIG. 1, showing the auxiliary tank and the present mounting apparatus removed from the main tank and harness assembly and showing, in broken lines, the mounting of the auxiliary air tank to the main breathing air tank and harness assembly.
Figure 3:
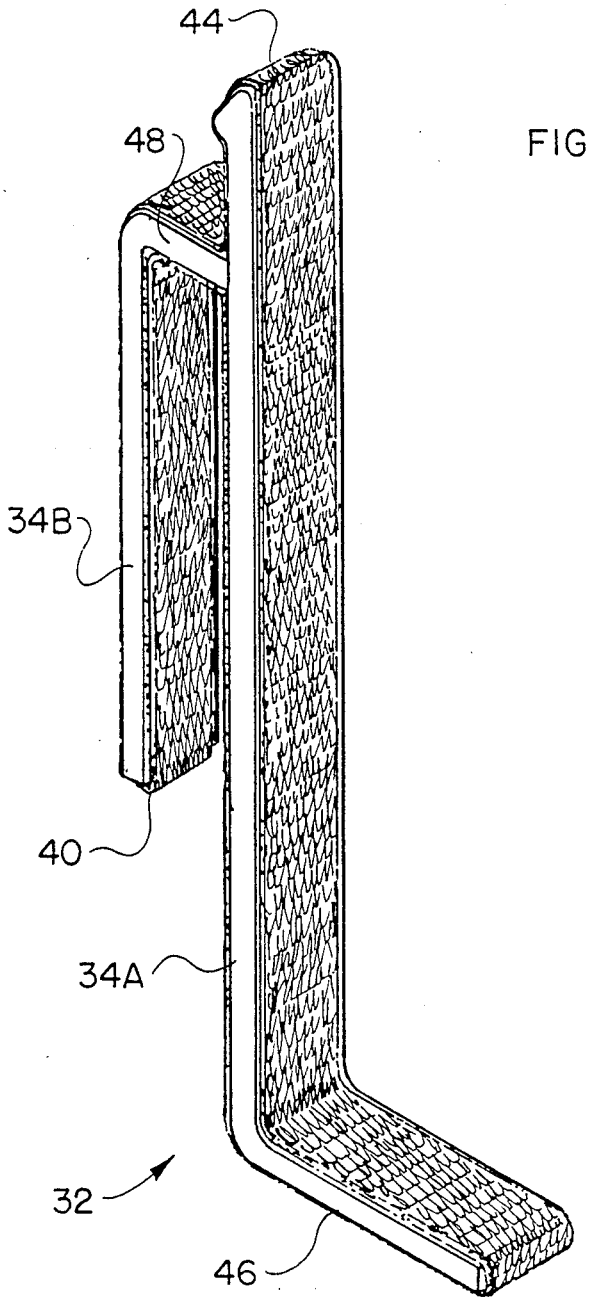
FIG. 3 is a perspective view of the bracket of the tank mounting the apparatus shown in FIG. 1.

In FIGS. 1–3, the preferred embodiment of the tank mounting apparatus of the present invention is illustrated. A breathing air tank user designated as 10, such as a diver, fire fighter or toxic chemical worker, wears a tank and harness assembly 12 which includes a harness 14 worn by the user 10 in a manner similar to the wearing of a vest and a main breathing air tank 16 secured to the harness by a retaining belt 18. An auxiliary breathing air tank 20 is releasably mounted to the main tank and harness assembly 12 by the mounting apparatus 22 of the present invention.

The harness 14 is of the type which is commercially available and generally includes a single vest-like portion and a curved, generally rigid plate (not shown) attached thereto for receipt of the main tank 16 thereagainst under the retaining action of the retaining belt 18. The main breathing air tank 16 is of the type commercially available which includes a metal-walled cylinder having a valve assembly 24 mounted at one axial end thereof. The valve assembly 24 provides selective access to the compressed air with which the main tank 16 is repetitively recharged. The retaining belt 18 is typically composed of a synthetic webbing and includes two belt portions, one of the belt portions having a buckle 26 secured thereto for selective buckling receipt of the free end of the other belt portion to selectively tighten and loosen the belt 18 about the main tank 16.

The auxiliary breathing air tank 20 is of the type commercially available and commonly referred to as a "Pony" tank, which essentially is a reduced scale version of the main tank 16. The auxiliary tank 20 is formed of an elongate metal-walled cylinder having a valve assembly 28 at one axial end thereof for selective access to the compressed air stored within the tank.

As best seen in FIG. 2, the mounting apparatus 22 of the present invention includes a metal bracket 32 having a pair of generally parallel metal legs 34A and 34B spaced relatively and in generally parallel, facing relation to one another, and a rigid clamping means 36 or other suitable means for rigidly clamping the auxiliary tank 20 to the bracket 32. The mounting legs 34A, 34B define therebetween a strap receiving area 38 and adjacent respective ends of the mounting legs 34A, 34B are unconnected to one another to define therebetween a strap insertion slot 40 opening into the strap receiving area 38. The rigid clamping means 36 includes a strap assembly for circumferentially encircling the auxiliary tank 20 including a pair of screw-type metal clamping belts 42. As best seen in FIG. 3, the metal bracket 32 is provided with a non-abrasive buffer material 44 which covers those surfaces of the bracket in contact with the auxiliary tank 20 or the main tank 16.

The leg 34A is formed as an integral portion of a generally L-shaped metal piece which includes a foot 46 oriented transversely to the leg 34A. The foot 46 is configured for engagement with a bottom surface of the auxiliary tank 20 and the leg 34A is configured for engagement with a lengthwise surface of the auxiliary tank. The metal clamping belts 42 extend around the circumference of the auxiliary tank 20 and the leg 34A to rigidly clamp the leg to the auxiliary tank.

The leg 34B is formed as an integral portion of a generally L-shaped rigid metal piece which includes a foot 48 oriented transversely to the leg 34B. The foot 48 is affixed by welding or other appropriate connecting means to the leg 34A and the leg 34B extends toward the foot 46 in relatively closely spaced facing relation to the leg 34A.

In operation, the auxiliary tank 20 is secured to the bracket 32 by positioning the auxiliary tank 20 on the leg 34A with the bottom of the tank supported on the foot 46. The metal clamping belts 42 are positioned in encircling relation about the auxiliary tank 20 and the leg 34A and are tightened to bring the auxiliary tank 20 and the leg 34A into a generally rigid relative disposition in which there is substantially no relative movement between the tank and the mounting leg 34A.

With the auxiliary tank thus rigidly mounted to the bracket 32, the belt portion of the belt 18, without the buckle is engaged with the buckle secured on the other belt portion with the main tank 16 aligned between the belt portions and the circular plate of the harness 14 for tightening the belt 18 firmly thereagainst. Thereafter, the mounting leg 34B is inserted downwardly between the belt 18 and the main tank 16 such that the belt 18 is inserted through the strap insertion slot 40 into the strap receiving area 38. Then, the belt 18 is tightened so that the mounting leg 34B is firmly secured between the belt 18 and the main tank 16 and such that the main tank 16 is securably mounted to the harness 14 by the belt 18. The spacing between the legs 34A, 34B advantageously allows the extent of the belt 18 which is inserted through and beyond the buckle to be disposed between the legs to preclude the belt extent from annoyingly freely flapping or moving. The belt extent can be secured by attachment means, such as Velcro brand attachment means, to the belt extent on the other side of the buckle.

With the belt 18 firmly tightened as described above, both the main tank 16 and the auxiliary tank 20 are disposed in generally upright positions and are maintained at a spacing from one another by the tank mounting apparatus 22. The mass of the auxiliary tank 20 applies a downward force to the bracket 32 which urges the mounting leg 34B to remain seated between the belt 18 and the main tank 16. Experience has shown that the combined effects of the downward force on the tank mounting apparatus 22 under the mass of the auxiliary tank 20 and the strap force of the belt 18 are sufficient to maintain the auxiliary tank 20 in its spaced, secured relationship to the main tank 16 during normal movements of the user 10 with the main tank and harness assembly 12 mounted thereon. Thus, the tank mounting apparatus 22 of the present invention releasably mounts the auxiliary tank 20 to the main tank 16 in a manner which minimizes harmful or abrasive or impact contact between the two tanks and to minimize relative movement between the auxiliary tank 20 and the main tank 16 which tends to exert destabilizing or unbalancing forces on the user 10.

The tank mounting apparatus 22 permits the auxiliary tank to be readily and conveniently removed from its rigid mounting disposition relative to the main tank 16, for example, when it is necessary to test or refill the auxiliary tank. Specifically, the user 10 need only manipulate the belt 18 to loosen the belt halves sufficiently for the leg 34B to be raised upwardly past the belt 18. Once the leg 34B has cleared the belt 18, the auxiliary tank 20 is released from engagement with the main tank 16 and cana be replaced, recharged with compressed air or otherwise serviced. Moreover, since the belt 18 remains in its buckled condition during the release of the auxiliary tank 20 from its rigid mounting disposition, the user 10 need only manipulate the belt to effect tightening of the belt against the main tank 16 to again firmly mount the main tank 16 to the harness 14.

As can be appreciated, the buffer materal 44 provides a non-abrasive interface between the metal surfaces of the bracket 32 and the auxiliary tank 20 and the main tank 16. The material 44 can be a commercially available synthetic textile material to be secured by adhesive or other appropriate securing means to the surfaces of the brackets 32.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. In combination with an underwater or like breathing apparatus of the type having a harness to be worn by a user, a main compressed air tank, and a strap for securing said main tank to said harness, an auxiliary compressed air tank and an apparatus for releasably mounting said auxiliary compressed air tank to said breathing apparatus in tandem with said main tank for normal wearing of said auxiliary tank as a part of said breathing apparatus and selective removal of said auxiliary tank for use without removal of the breathing apparatus by the user, said mounting apparatus comprising:

a bracket having a pair of mounting legs connected in relatively closely spaced facing relation to one another and defining therebetween a strap receiving area with respective adjacent ends of said legs unconnected to one another defining a strap insertion slot into said strap receiving area; and means for clamping one said mounting leg rigidly to the auxiliary tank with the other said mounting leg spaced outwardly therefrom, wherein the other said leg is selectively insertable into and removable from a disposition between the main tank and the securing strap of the harness in which the strap is inserted through said strap insertion slot into said strap receiving area of said bracket when the strap is in a loosened condition and in which the other said leg is rigidly held between the strap and the main tank when the strap is tightened to effect rigid mounting of the auxiliary tank to the main tank.

2. A releasable mounting apparatus according to claim 1 and characterized further in that said bracket comprises a geneally L-shaped rigid member having said one mounting leg and a foot oriented transversely to one another and configured for engagement of said foot with a bottom surface of the auxiliary tank, and for engagement of said one leg with a lengthwise surface of the auxiliary tank, and said rigid clamping means includes strap means for generally circumferentially encircling the auxiliary tank and said one leg to rigidly retain the auxiliary tank and said L-shaped rigid member in engagement with one another.

3. A releasable mounting apparatus according to claim 2 and characterized further in that said strap means includes a pair of screw-type metal clamping bands for generally circumferentially encircling the auxiliary tank and said one said mounting leg at spaced locations along the auxiliary tank.

4. A releasable mounting apparatus according to claim 1 and characterized further by a generally non-abrasive covering secured to each said mounting leg of said bracket for minimizing abrasive contact between the bracket and the auxiliary and main tanks.

5. A releasable mounting apparatus according to claim 2 and characterized further in that said bracket comprises a second generally L-shaped rigid member having said other mounting leg and a second foot oriented transversely to one another, said second foot being affixed to said one mounting leg at a spacing from said foot of said first-mentioned L-shaped rigid member and said other mounting leg extending toward said foot of said first-mentioned L-shaped rigid member in relatively closely spaced facing relation to said one mounting leg.

* * * * *

UNITED STATES PATENT AND TRADEMARK OFFICE

CERTIFICATE OF CORRECTION

PATENT NO. : 4,949,889

DATED : August 21, 1990

INVENTOR(S) : Ronald H. Carson

It is certified that error appears in the above-identified patent and that said Letters Patent is hereby corrected as shown below:

Column 1, Line 36, reads "value" but should read -- valve --.

Column 2, Lines 32-34, after "breathing apparatus" (Line 32) delete -- for releasably mounting an auxiliary compressed air tank to a breathing apparatus --.

Column 5, Line 24, reads "cana" but should read -- can --.

Column 5, Line 31, reads "materal" but should read -- material --.

Column 6, Line 30, reads "geneally" but should read -- generally --.

Signed and Sealed this

Twenty-second Day of September, 1992

*Attest:*

DOUGLAS B. COMER

*Attesting Officer*

*Acting Commissioner of Patents and Trademarks*